US012736274B2

(12) United States Patent
Rehage et al.

(10) Patent No.: US 12,736,274 B2
(45) Date of Patent: Sep. 15, 2026

(54) DOMESTIC APPLIANCE COMPRISING A STORAGE CONTAINER

(71) Applicant: PAUL HETTICH GMBH & CO. KG, Kirchlengern (DE)

(72) Inventors: Daniel Rehage, Münster (DE); Steffen Tenhumberg, Osnabrück (DE); Gerrit Staufenberg, Münster (DE); Johannes Tiwisina, Borgholzhausen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 251 days.

(21) Appl. No.: 18/036,696

(22) PCT Filed: Nov. 9, 2021

(86) PCT No.: PCT/EP2021/081113
§ 371 (c)(1),
(2) Date: May 12, 2023

(87) PCT Pub. No.: WO2022/101202
PCT Pub. Date: May 19, 2022

(65) Prior Publication Data

US 2023/0408179 A1 Dec. 21, 2023

(30) Foreign Application Priority Data

Nov. 16, 2020 (DE) ..... 10 2020 130 186.3

(51) Int. Cl.
*F25D 23/06* (2006.01)

(52) U.S. Cl.
CPC ..... *F25D 23/065* (2013.01)

(58) Field of Classification Search
CPC ..... F25D 23/065
(Continued)

(56) References Cited

U.S. PATENT DOCUMENTS 2,832,590 A * 4/1958 Youngberg ..... E05F 11/06 74/424.6
2,861,857 A * 11/1958 Lee ..... A47B 83/045 312/312

(Continued)

FOREIGN PATENT DOCUMENTS

CN 110094929 A 8/2019
EP 1630506 B1 4/2009

(Continued)

OTHER PUBLICATIONS

Machine Translation of JP 05-296647 from http://dossier.ipdl.inpit.go.jp/text_trans.html (Year: 1993).*

(Continued)

*Primary Examiner* — Daniel J Troy
*Assistant Examiner* — Timothy M Ayres
(74) *Attorney, Agent, or Firm* — PATENT PORTFOLIO BUILDERS PLLC

(57) ABSTRACT

A domestic appliance includes a carcass and a sliding element extendible using a drive assembly situated in or on the carcass. A liftable storage container can be moved out of the carcass by the sliding element. The domestic appliance also includes a push-chain assembly having at least one push chain that is driven by the drive assembly. The at least one push chain is fixed to the storage container by a free end and extends between the drive assembly and the storage container through a return guide situated on the sliding element.

20 Claims, 15 Drawing Sheets

Figure 1A:
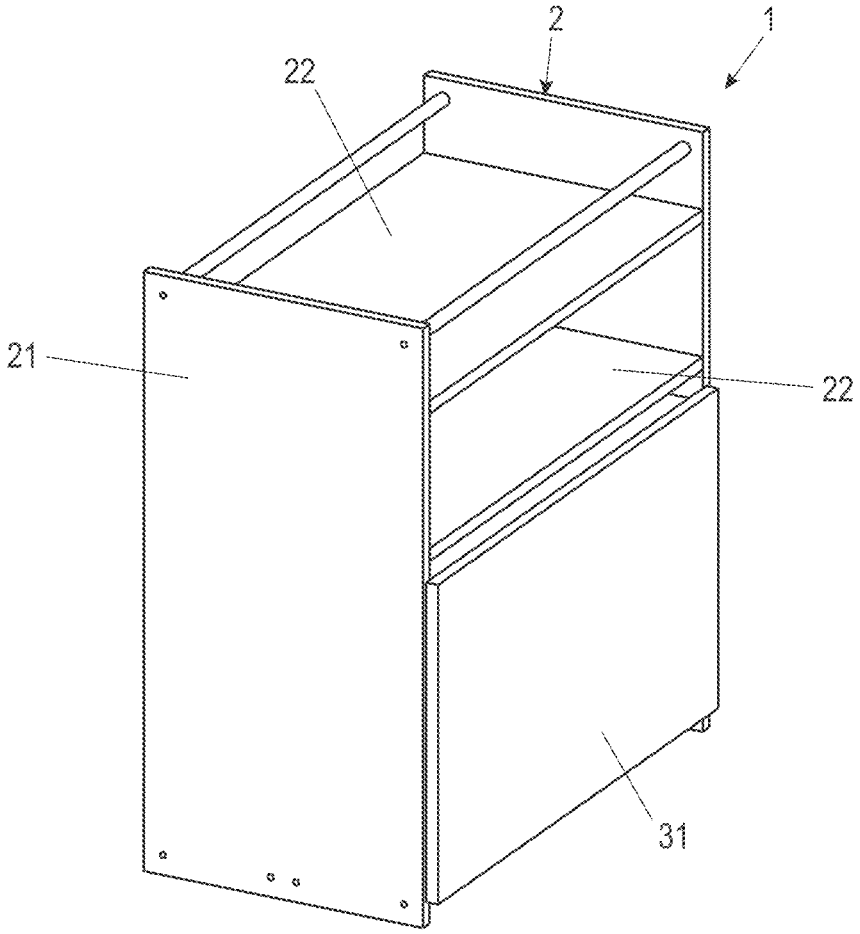

(58) Field of Classification Search
USPC ..... 312/402
See application file for complete search history.

(56) References Cited

U.S. PATENT DOCUMENTS 4,014,136 A * 3/1977 Hemens ..... F16G 13/20 74/606 R
5,156,574 A * 10/1992 Gai ..... E05F 11/06 474/212
5,271,182 A * 12/1993 Greisner ..... E05F 15/619 49/325
5,429,043 A * 7/1995 Becker ..... F24C 15/16 99/450
5,797,666 A * 8/1998 Park ..... A47B 21/0073 312/223.3
5,896,702 A * 4/1999 Wæhrens ..... E05F 15/619 49/331
6,224,037 B1 * 5/2001 Novick ..... F16G 13/20 254/95
6,523,919 B1 2/2003 Israelsen et al.
7,600,833 B2 * 10/2009 Oh ..... A47B 51/00 312/402
8,341,931 B2 * 1/2013 Ando ..... F16G 13/20 187/250
8,500,101 B2 * 8/2013 Yaoi ..... B66F 13/005 254/358
8,776,491 B2 * 7/2014 Oitaka ..... F16G 13/20 254/358
9,255,630 B2 * 2/2016 Saji ..... F16G 13/20
10,234,195 B2 * 3/2019 Yasaka ..... F25D 25/025
10,295,018 B2 * 5/2019 Etori ..... B66F 7/28
10,627,156 B2 * 4/2020 Kang ..... F25D 25/025
10,724,788 B2 * 7/2020 Choi ..... F25D 25/025
11,761,702 B2 * 9/2023 Choi ..... F25D 25/025 62/56
2007/0169414 A1 * 7/2007 Soerensen ..... E05F 15/627 49/325
2011/0197361 A1 * 8/2011 Hornbach ..... A61G 7/012 5/618
2013/0312554 A1 * 11/2013 Saji ..... F16G 13/20 74/89.21

FOREIGN PATENT DOCUMENTS

ES 2353554 T3 3/2011
JP 05-296647 * 11/1993
JP H05296647 A 11/1993
KR 20180138083 A 12/2018
KR 102309149 B1 10/2021
WO 2020149535 A1 7/2020

OTHER PUBLICATIONS

International Search Report and Written Opinion mailed Mar. 4, 2022 in related/corresponding International Application No. PCT/EP2021/081113.
Search Report created Jun. 28, 2021 in related/corresponding DE Application No. 10 2020 130 186.3.

* cited by examiner

DOMESTIC APPLIANCE COMPRISING A STORAGE CONTAINER

BACKGROUND AND SUMMARY OF THE INVENTION

Exemplary embodiments of the invention relate to a domestic appliance, in particular a refrigerator or a freezer, having a carcass and a sliding element extendible therefrom, wherein a liftable storage container can be moved out of the carcass by means of the sliding element.

Domestic appliances such as refrigerators or freezers often have, in addition to compartments in which items such as foodstuffs can be stored, containers that can be moved out of the carcass, e.g., stored on guide rails, in order to be able to put away or remove products to be stored. When the containers are arranged in a lower area of a domestic appliance that extends to the base, this can be cumbersome for users.

EP 1 630 506 B1 describes a refrigerator in which a basket is displaceably arranged in a drawer, wherein the basket is assigned a lifting device which, after the drawer has been moved out, can lift the basket, driven by a drive unit, so that products can be stored or removed more easily. The lifting device comprises a frame mounted for linear movement on a vertically aligned guide rail, on which the basket is positioned as a storage container. For raising and lowering the lifting frame, an electromotively driven pivot arm is provided, at the free end of which a roller is rotatably mounted that rolls on an underside of the lifting frame. The guides for the lifting frame and also the drive unit with the pivot arm are mounted on the inside of a front panel which, mounted on the aforementioned pull-out guides, can be moved out of the carcass.

A disadvantage of this arrangement is that the drawer is extended manually, which in turn requires the user to bend down to the drawer. It would therefore be desirable if the drawer could also be extended automatically. However, this would then require either two separate drive units for the pull-out and lift-out movements, respectively, or a drive unit that is coupled in a complicated manner temporarily with the pull-out movement and temporarily with the lift-out movement.

Exemplary embodiments of the present invention are directed to a domestic appliance of the type mentioned above, in which a storage container can be moved and lifted from a carcass without requiring manual intervention. Exemplary embodiments of the present invention are also directed to achieve this with a single drive unit that is mechanically simple and drives both the pushing and the lifting movement in a coordinated manner without a complicated and error-prone sequence control.

A domestic appliance according to the invention is characterized in that a push-chain assembly is provided having at least one push chain that is driven by the drive assembly, wherein the at least one push chain is fixed to the storage container by a free end and extends between the drive assembly and the storage container through a deflection guide arranged on the sliding element.

A push chain is a chain in which the mobility between two chain links is only possible in one pivoting direction of the links to each other, whereby the chain can not only be loaded in tension, but can also transmit push forces. According to the invention, this property is exploited to achieve with one element—the push chain—the sliding movement of the sliding element with the bearing container and, after deflection, the lifting movement of the bearing container.

The at least one push chain driven by the drive assembly thus acts directly only on the storage container, but the deflection causes the sliding element and storage container to experience a force in the pull-out direction.

The fact that considerably lower forces are required for the sliding movement than for the lifting movement means that a sequence control is inherent: starting from a retracted state of the sliding element, it is first extended to a stop before further pushing of the push chain leads to lifting of the storage container. When the push chain is retracted again, this sequence runs in reverse without the need for a complex sequence control. For this purpose, the deflection guide is preferably designed in such a way that it converts a horizontal movement of the push chain into a vertical movement. For example, it can have a quarter-circular slideway for the push chain.

Further advantageously, the at least one push chain simultaneously represents a lifting guide for the storage container, which also simplifies the design structure.

In the context of the application, the term "storage container" refers to any arrangement enabling objects to be stored to be accommodated. In particular, the storage container can also be of multi-part design and comprise a frame-like receptacle, for example, which accommodates at least one removable container.

In an advantageous design of the domestic appliance, the at least one push chain is fixed to a rear (transverse) side of the storage container as seen in the pull-out direction, in particular centrally on this side. A single push chain is thus sufficient for lifting, especially in the case of a storage container that is not excessively wide. To support the lifting guide, in a further development it can be provided that the storage container is additionally mounted on the sliding element so as to be vertically displaceable via a sliding guide.

In a further advantageous design of the domestic appliance, the push-chain assembly comprises a plurality of push chains extending parallel to and spaced apart from each other, of which, for example, one is fixed centrally to the rear (transverse) side of the storage container as previously described and a further one is fixed to each of the two front corner regions or sides of the storage container. In one design, it is further provided that at least two of the plurality of push chains are spaced parallel to each other in a direction of extension of the sliding element, whereby stable support of the storage container against tipping backward (i.e., against the direction of extension) is achieved during lifting.

Preferably, the multiple push chains are moved synchronously by the drive assembly. This can be done mechanically, for example, via a synchronous shaft extending transversely to the alignment of the push chains, or by stepper motors or by DC motors with Hall sensors.

The limited freedom of movement of the chain links of the push chains prevents them from kinking and thus prevents the storage container from tilting forward, i.e., away from the carcass. The fact that push chains are arranged in the front and rear areas of the storage container and that they are also extended synchronously in parallel also prevents the storage container from tilting backwards, i.e., towards the carcass.

High stability of the lifting guide is achieved by the push-chain assembly in particular if the at least one push chain is non-rotatably connected at its end to the storage container. For this purpose, at least one chain sleeve can be attached to or formed on the storage container, for example, in which the free end of the at least one push chain is non-rotatably fixed.

In another advantageous design of the domestic appliance, the drive assembly comprises a drive motor having an output gear that engages the at least one push chain. Preferably, the drive motor acts on the output gear via a self-locking gear, for example a worm gear. The storage container then remains in the raised position without further action. Alternatively, blocking or braking devices may be provided to prevent the bearing container from sinking. It is also conceivable to continue to energize the drive motor in the raised position of the storage container with a lower operating current in order to achieve a holding function.

The sliding element can be guided linearly on the carcass by at least one pull-out guide. Preferably, the pull-out guide is equipped with rolling elements, which is associated with a smooth-running guide. A smooth-running guide is advantageous for the sequence of movements. It ensures the storage container is not raised until the sliding movement has already been completed, or the sliding movement only takes place when the storage container has been lowered.

In addition, a retraction lock, e.g., by means of latching means or a pawl, can be provided preventing the pull-out guide from retracting as long as the storage container is still raised. This retraction lock can act non-positively and/or positively and can be actuated or released, for example, by the storage container. As an alternative, it is possible to consider the use of electromechanical switches or any kind of sensors that detect whether the storage container is in the lowered or raised position.

Particularly advantageously, the described arrangement with the liftable storage container can be implemented in a refrigerator and/or freezer as a domestic appliance.

BRIEF DESCRIPTION OF THE DRAWING FIGURES

Figure 1B:
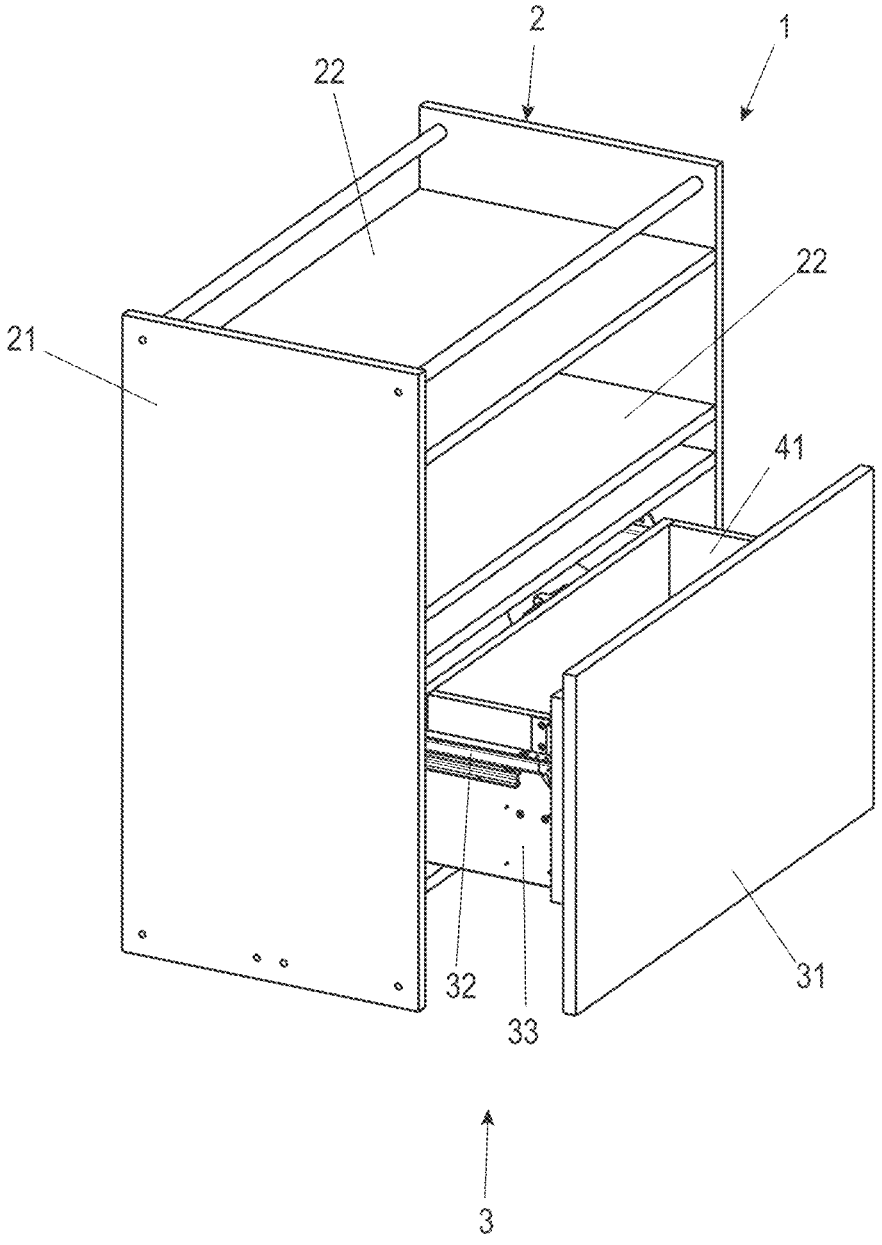
Figure 1C:
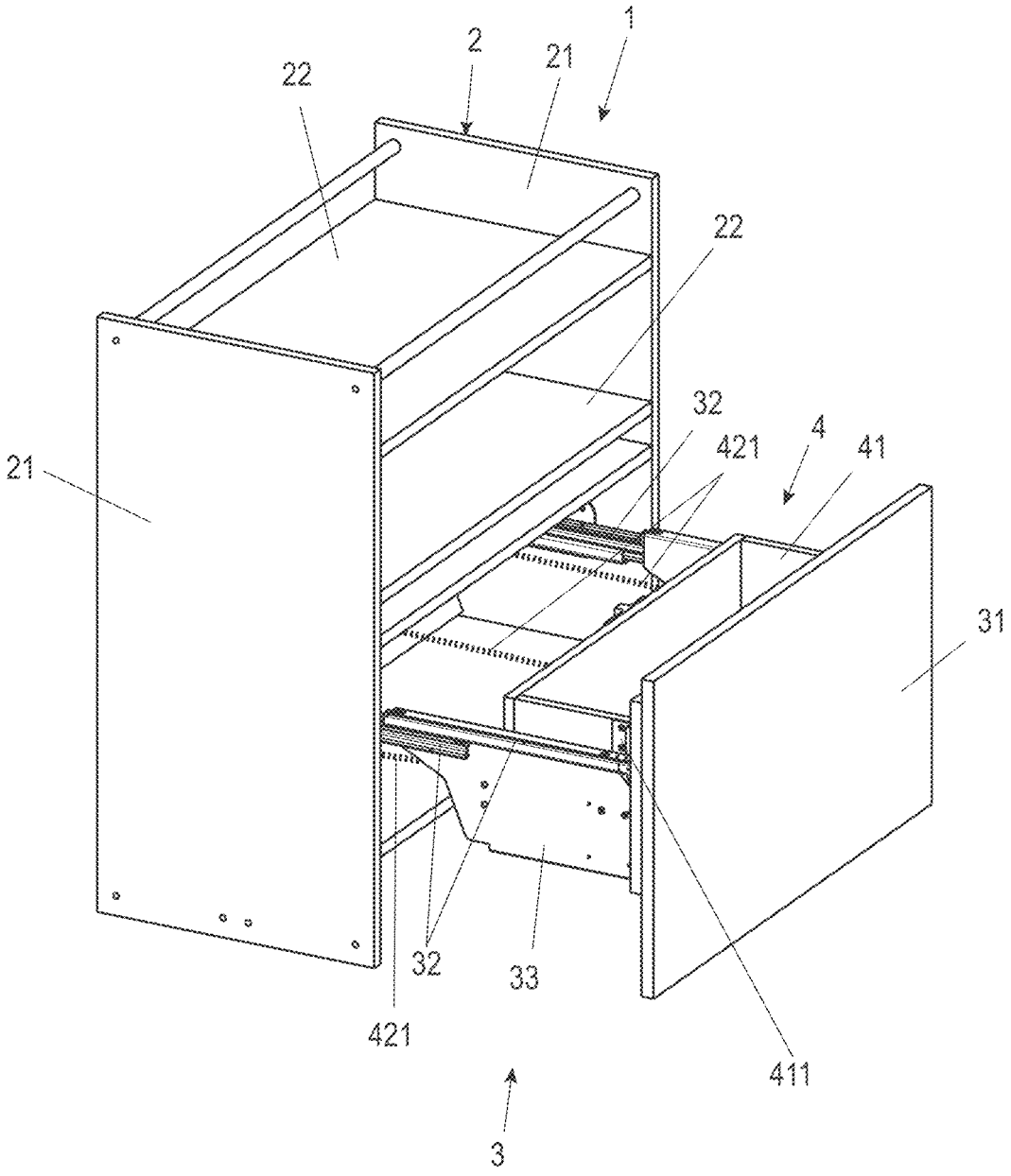
Figure 1D:
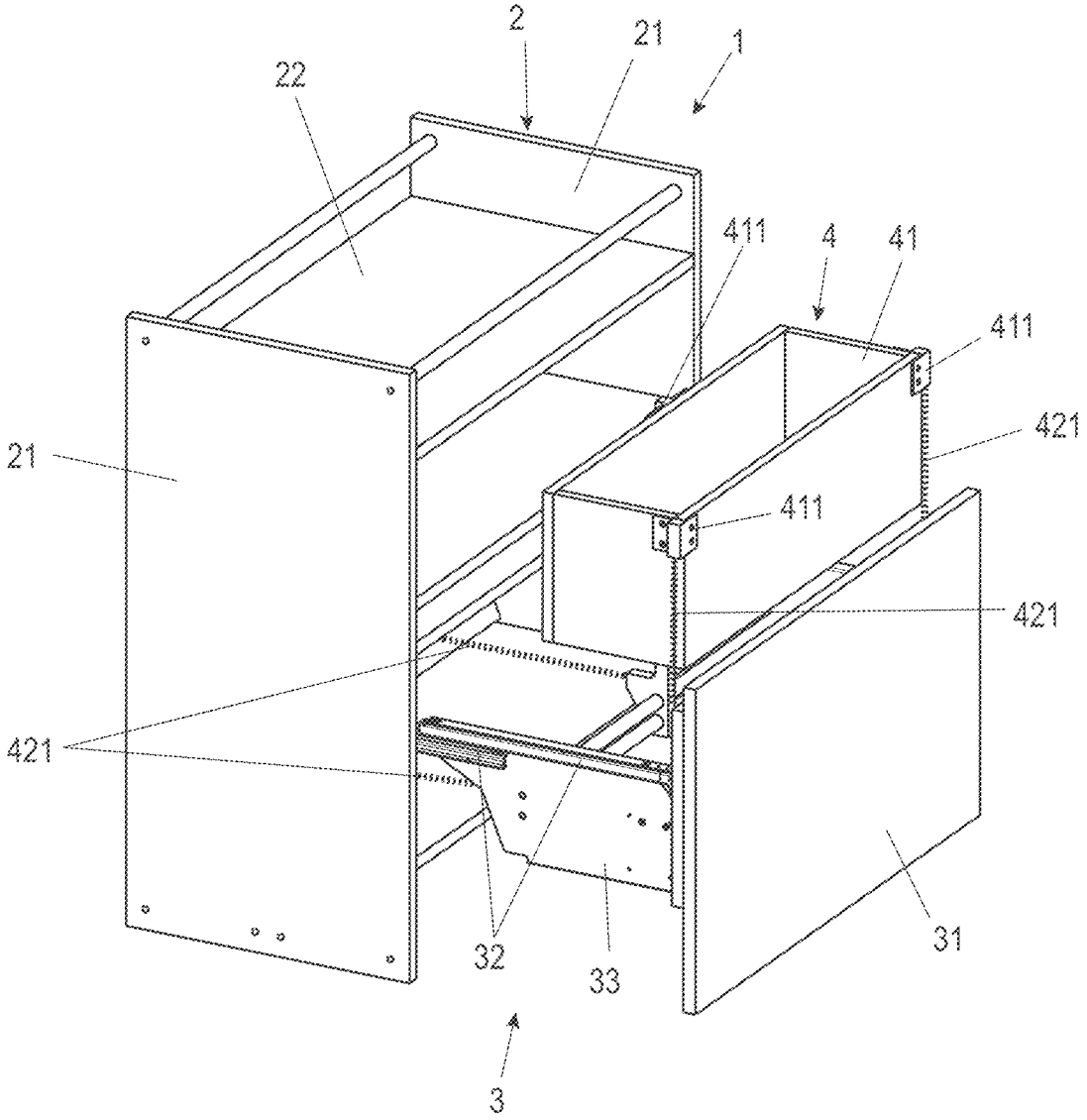
Figure 2A:
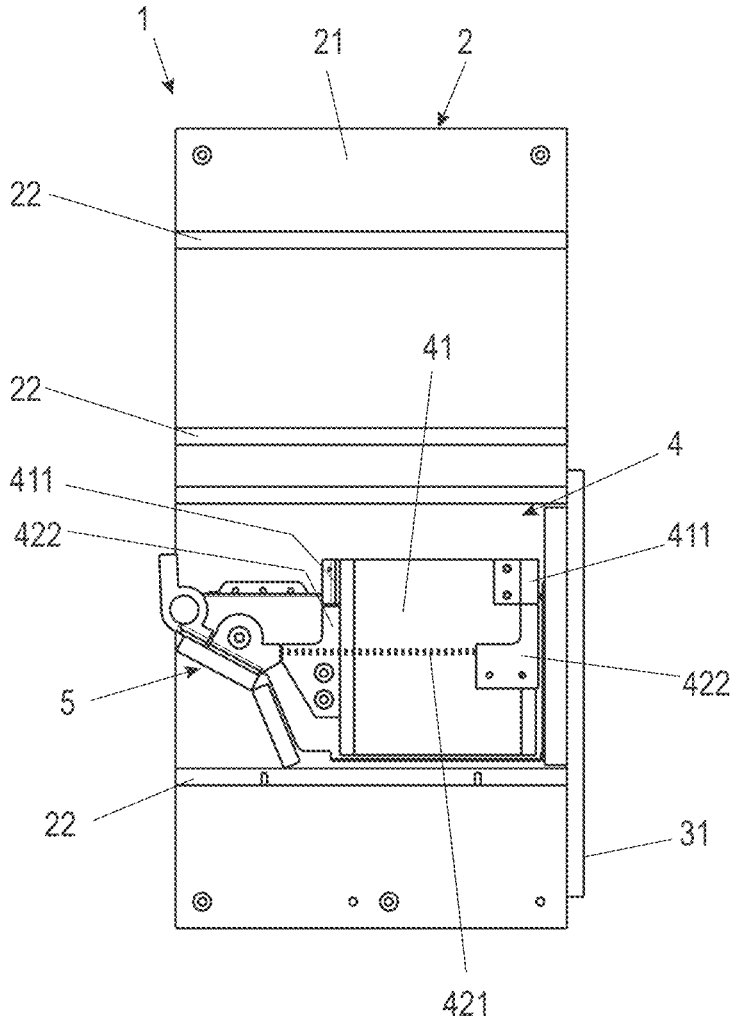
Figure 2B:
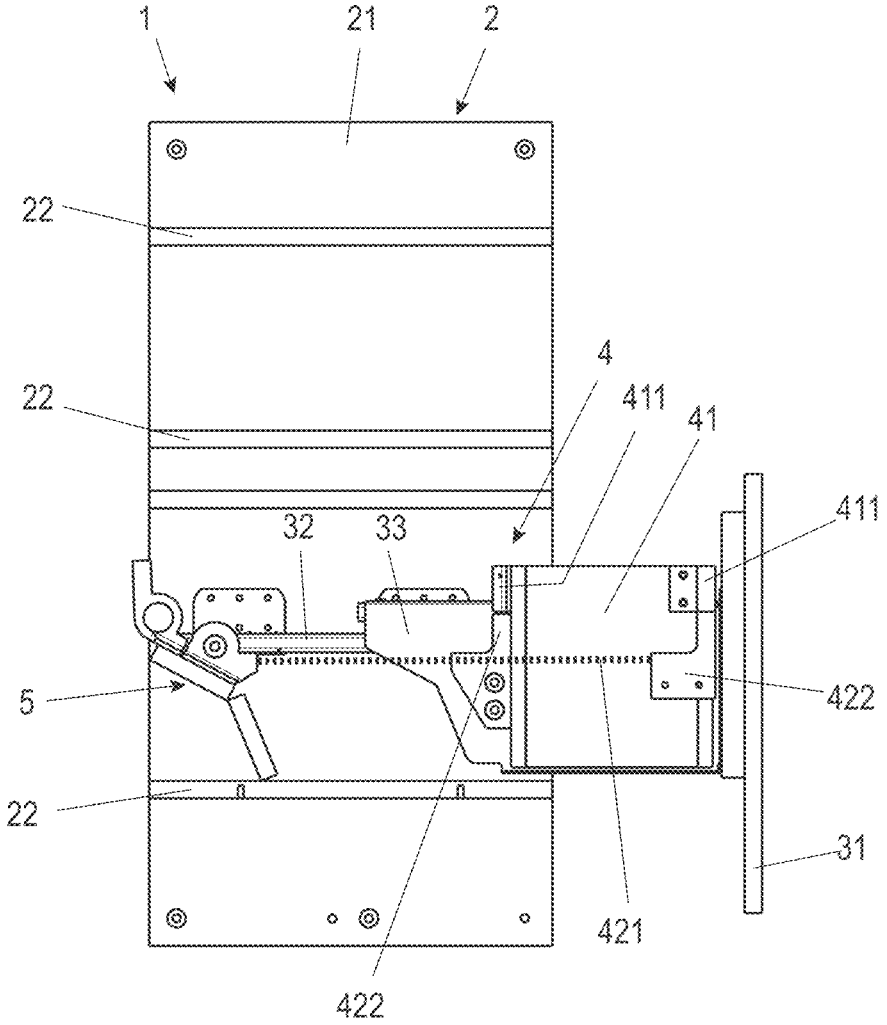
Figure 2C:
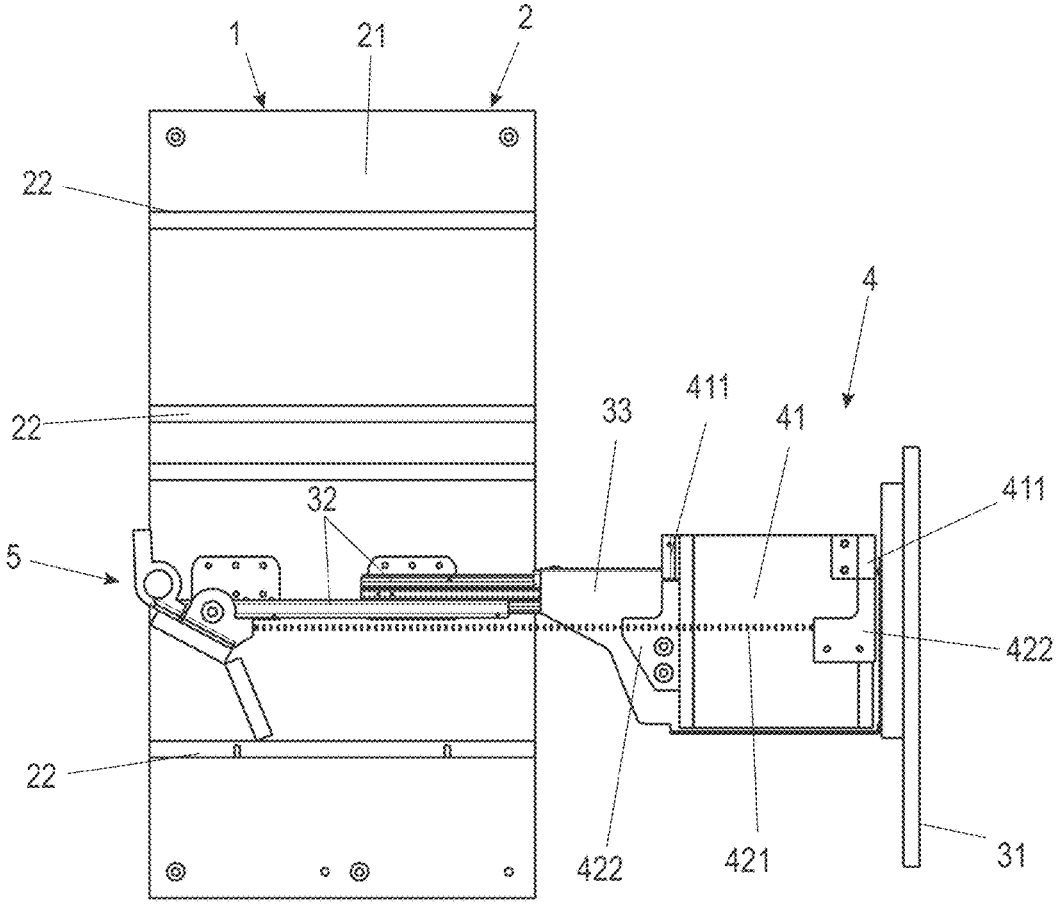
Figure 2D:
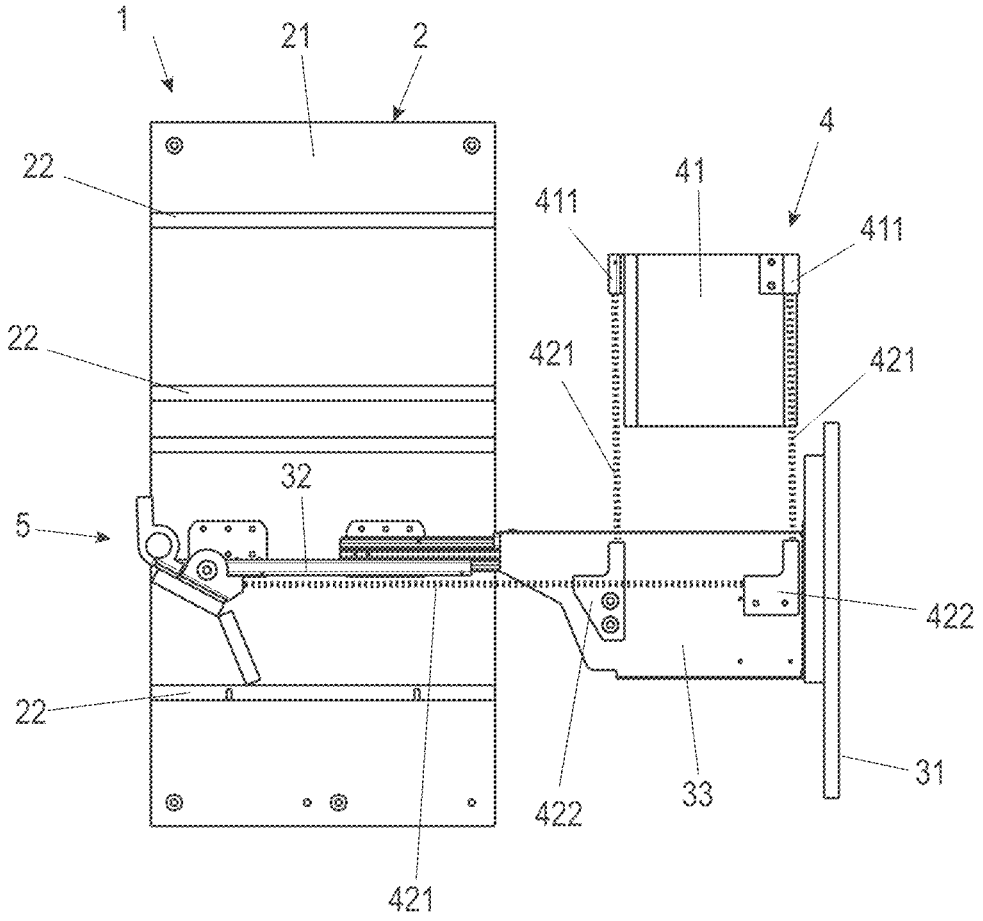
Figure 3A:
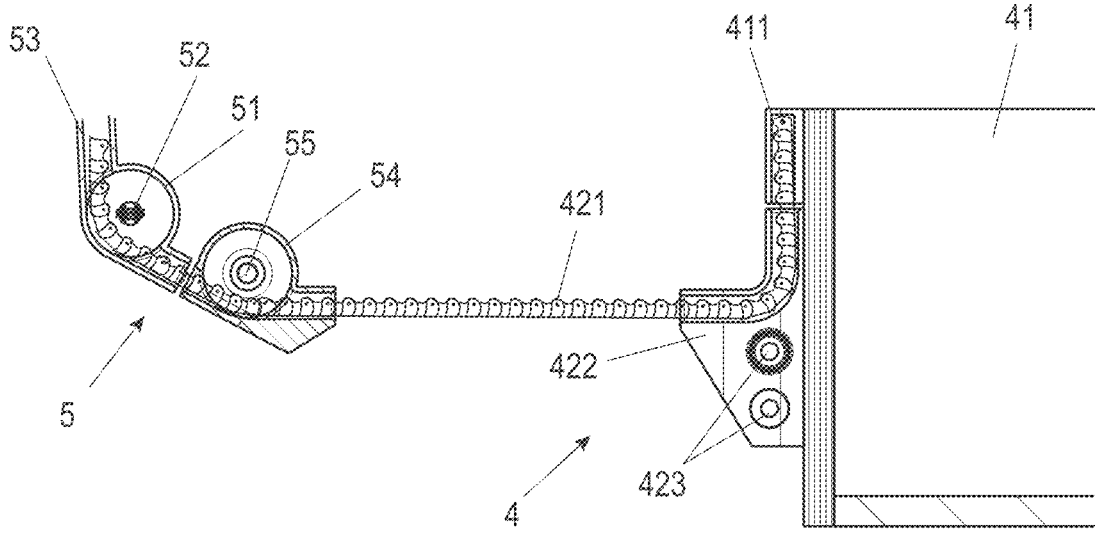
Figure 4:
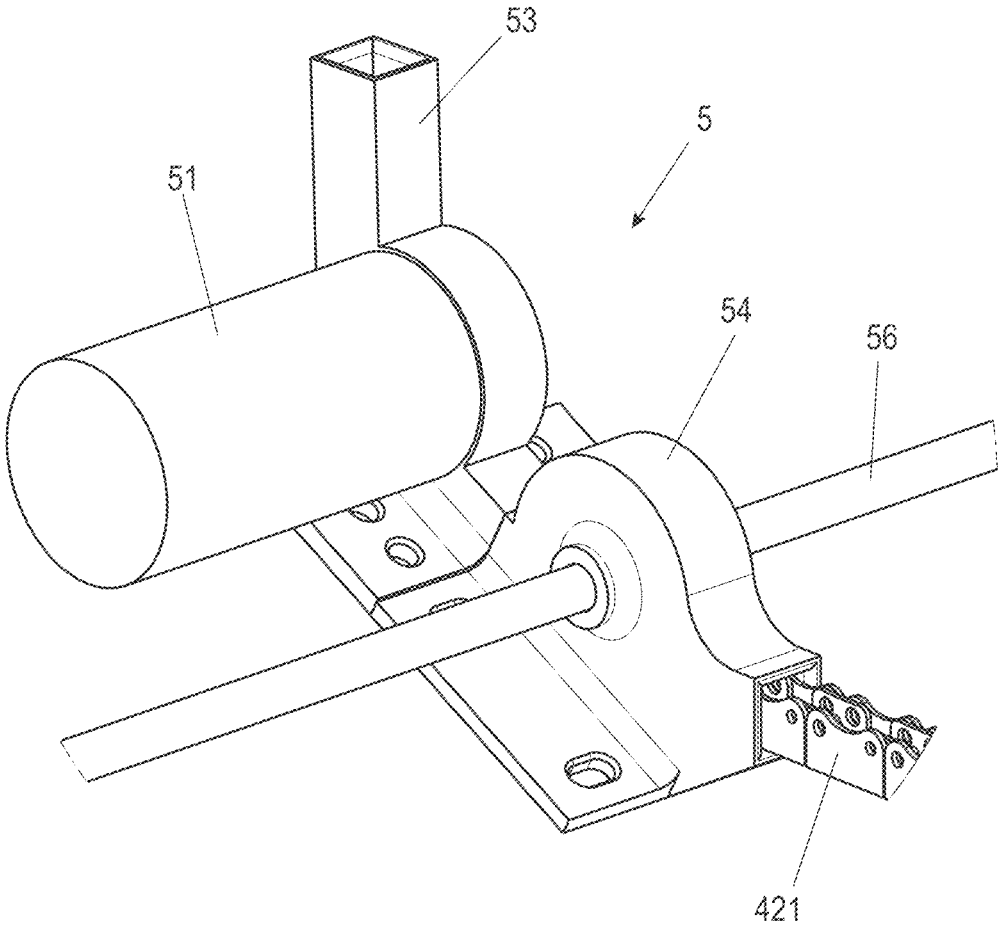
Figure 5:
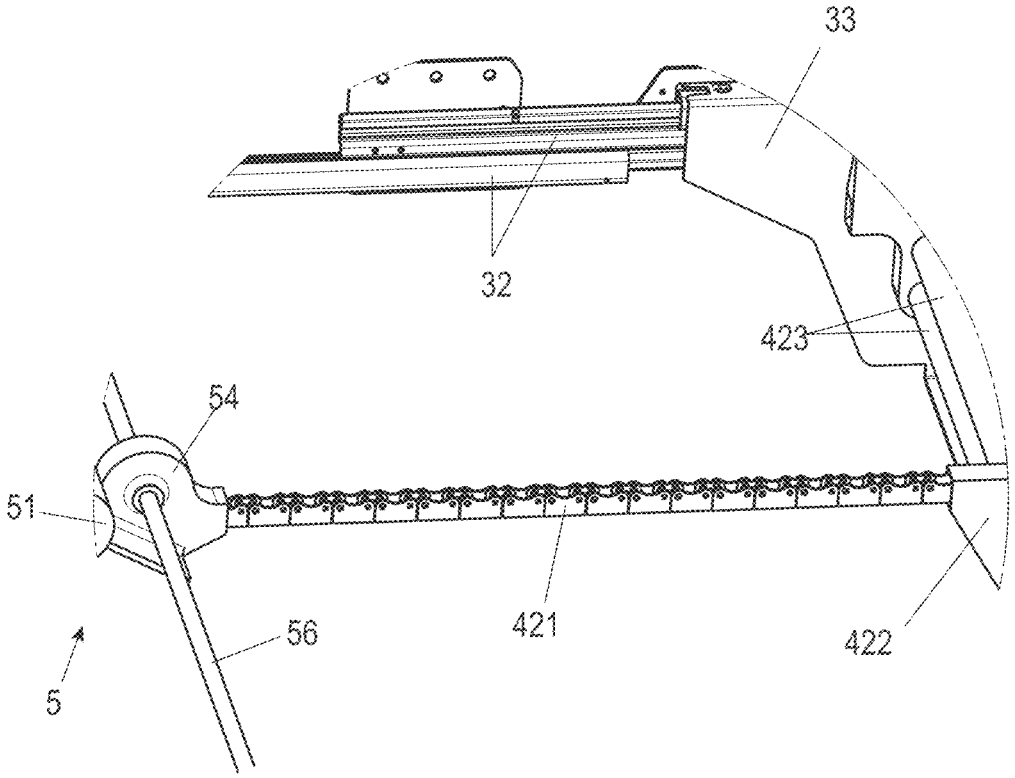
Figure 6:
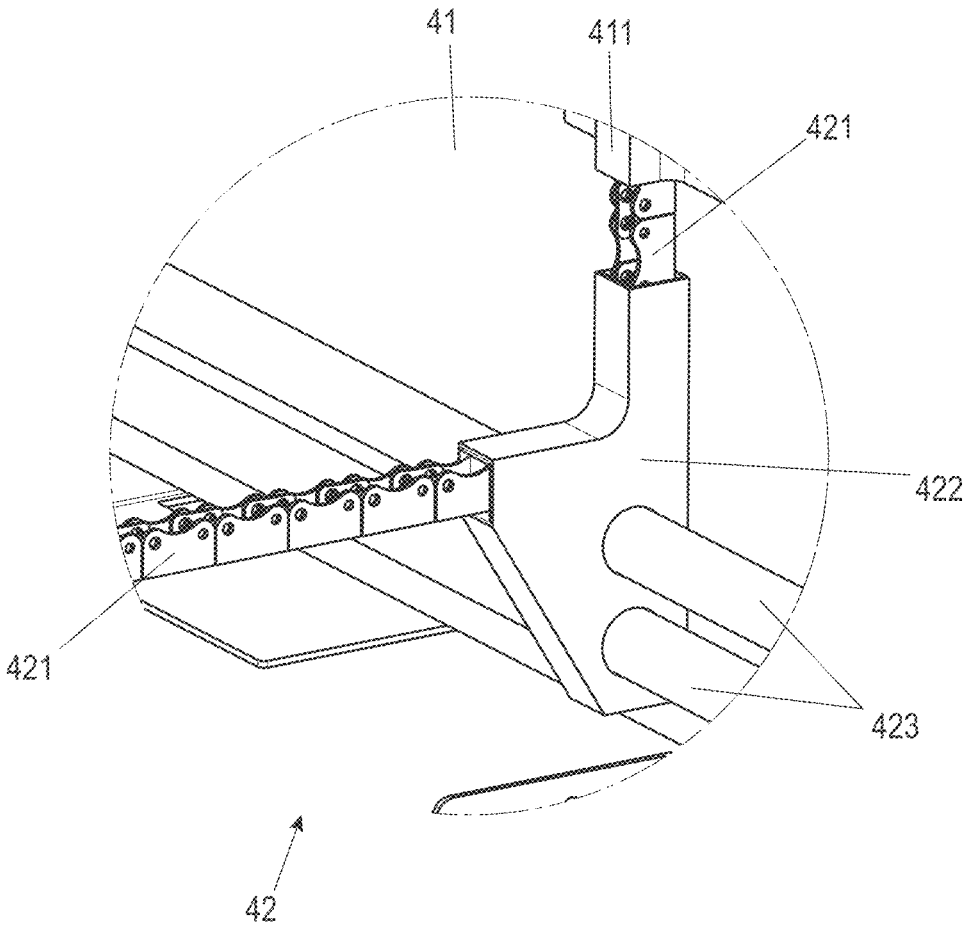
Figure 7:
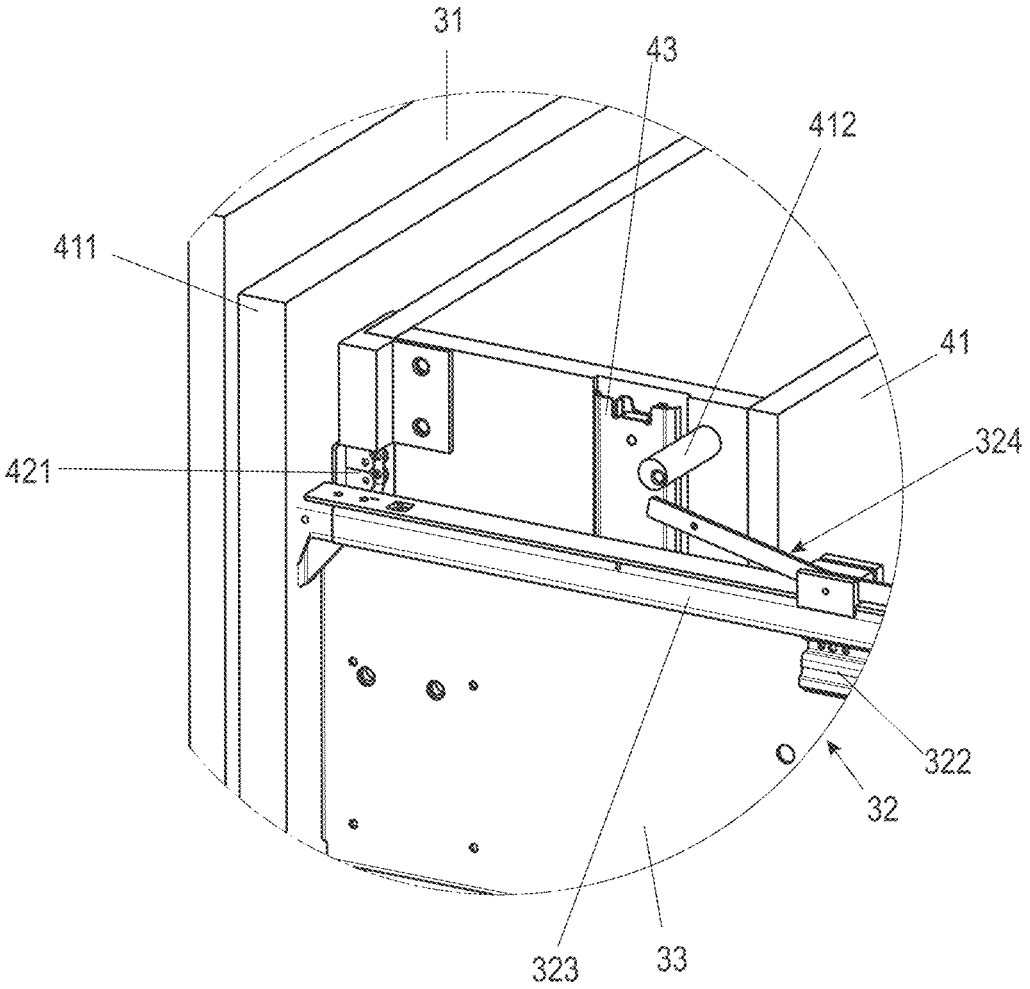
Figure 8:
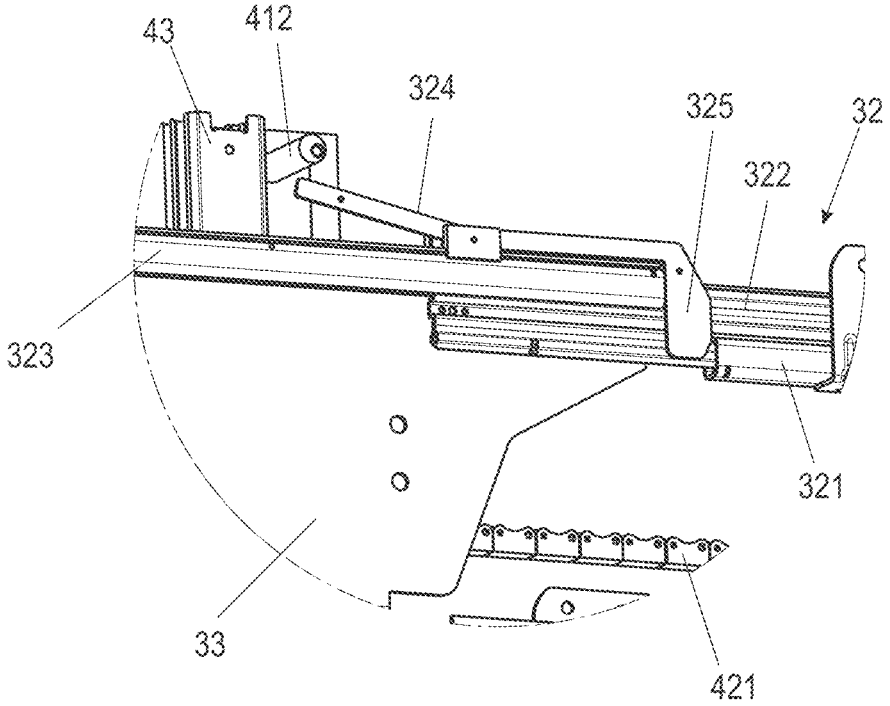

The invention is shown below by means of exemplary embodiments with the aid of figures, wherein:

| | |
|---|---|
| FIGS. 1a-d | show an isometric representation of a domestic appliance in a first exemplary embodiment at various stages of a storage container movement sequence; |
| FIGS. 2a-d | show in each case a sectional view of the domestic appliance of FIGS. 1a-d; |
| FIGS. 3a, b | respectively show a sectional view of a sliding and lifting guide of the domestic appliance of the first exemplary embodiment in different positions of the storage container; |
| FIG. 4 | shows an isometric detail view of a drive unit of the domestic appliance of the first exemplary embodiment; |
| FIGS. 5, 6 | show various isometric detailed representations of the sliding and lifting guide of the domestic appliance of the first exemplary embodiment; and |
| FIGS. 7, 8 | show two different isometric detailed views of a second exemplary embodiment of a domestic appliance with a retraction lock of the pull-out guide. |

In all figures, identical reference signs indicate identical or similarly acting elements. For reasons of clarity, not every element in all figures is given a reference sign.

DETAILED DESCRIPTION

In the description, terms such as "above", "below", "left", "right" initially refer to the exemplary representation selected in the respective figures. With regard to the terms "above" and "below", the representation in the figures coincides with the orientation usually adopted in space. The terms "front" and "rear" are to be understood with respect to the domestic appliance, wherein at the front of the domestic appliance there is a front side which faces the user and on which there are doors, flaps or similar elements of the domestic appliance.

FIGS. 1*a-d* show a first exemplary embodiment of a domestic appliance 1 in an isometric view in each case in different states of movement of a storage container 41. In FIGS. 2*a-d*, the domestic appliance 1 is shown in different vertical sections to the same states of movement of the storage container 41 in each case.

Before details of the technical realization are explained below, an overview of the movement sequence is first given. The partial images with the same suffix (a, b, c, d) of the two figure sequences in FIGS. 1*a-d* and 2*a-d* respectively show the same state in the movement sequence.

The domestic appliance 1 has a carcass 2 with side walls 21 and two or more bases 22. A rear wall is not shown for reasons of clarity. The domestic appliance 1 may be, for example, a refrigerator or freezer. As such, it generally has a multi-shell insulating carcass and technical cooling devices and sealing devices for closing openings. For reasons of clarity, these are not reproduced in the illustrations of this application. The representation of the carcass 2 is to be regarded in that sense as a purely schematic representation. The carcass 2 has openings facing forward, one of which is closed here by a front panel 31 (FIGS. 1*a*, 2*a*).

The front panel 31 is part of a sliding element 3, which also comprises a pull-out guide 32 on which the front panel 31 is guided and through which the front panel 31 can be pulled out of the carcass 2. A connection of the front panel 31 with the pull-out guide is realized by lateral frame elements 33. The sliding element 3 is constructed similarly to a drawer, for example, but unlike the latter it does not require a base.

When a release device is actuated, the movement sequence starts with the extension of the sliding element 3, as can be seen in FIGS. 1*b* and 2*b*. The entire movement sequence, i.e., also the extension of the sliding element 3, is driven by a drive assembly 5, which is visible in the sectional views in FIGS. 2*a-d*, for example. The drive assembly 5, which comprises, for example, a drive motor with a downstream gearbox, is explained in more detail in connection with FIG. 4.

The drive assembly 5 is controlled by a control device (not visible here) and is actuated by the release device. The release device can be, for example, a manually actuated pushbutton arranged at a convenient reach height on the domestic appliance 1. Alternatively, or additionally, remote triggering can also be performed, for example wirelessly via a radio switch coupled to the control device, which can also be a mobile terminal, for example a cellphone of the user. Touch- or proximity-sensitive switches and/or voice- or gesture-controlled switches may also be used.

With the sliding element 3, the storage container 41 initially moves out of the carcass 2 essentially forward (cf. FIGS. 1*b*, 2*b*) until it reaches a fully extended position (cf. FIGS. 1*c*, 2*c*). In the further movement sequence (cf. FIGS. 1*d*, 2*d*), the storage container 41 is raised upward while maintaining its orientation.

It is understood that the opening sequence shown in FIGS. 1*a-d* or 2*a-d* can be correspondingly run through in reverse to lower the storage container 41 again and move it into the carcass 2. This can preferably be carried out after a renewed request by the user. Alternatively, or additionally, it is conceivable that after a certain time has elapsed for which the storage container 41 is extended into the positions shown in FIG. 1*d*, this is automatically retracted again, possibly after an acoustic signal as an indication. In this way, an inadvertent failure to close the domestic appliance 1 can be prevented. Sensors can be used to detect the presence of a person in the area of the domestic appliance 1, so that retraction is only carried out when no person is in the vicinity of the domestic appliance 1, in order to prevent a storage container 41 which has been deliberately left in the extended position from being retracted undesirably and/or to exclude a risk of injury in the event of a surprising retraction.

Details of the technical realization of the previously described movement sequence are explained below.

As already mentioned, the entire movement is driven by the drive assembly 5, which is arranged in a rear area in the carcass 2. Alternatively, the drive assembly 5 can also be arranged outside the carcass 2.

The storage container 41 and indirectly the sliding element 3 are connected to the drive assembly 5 via a push-chain assembly 42, which in the present case comprises three push chains 421. A push chain is a chain in which the mobility between two chain links is only possible in one pivoting direction of the links to each other. This is achieved by a corresponding geometry of the chain links, which are rounded in end regions only towards one side of the chain, so that the chain links can be pivoted against each other in this direction, whereas they rest against each other by corresponding shaping when bent in the opposite direction. A possible shaping of the push chain 421 can be seen, for example, in FIG. 4 in an enlargement.

The three push chains 421 are synchronously pushed forward or retracted backward by the drive assembly 5. Within the sliding element 3, the push chains 421 each run through deflection guides 422, in which they are deflected upward along a quarter-circle-shaped slideway. Accordingly, the push chains 421 are aligned in such a way that upward deflection is possible. The push chains 421 are then coupled to the storage container 41, in the example shown by chain sleeves 411 into which the push chains 421 are inserted by at least one, preferably several chain links. The chain sleeves 411 may be arranged directly on the storage container 41, or indirectly, for example on a frame into which the storage container 41 is inserted.

Of the three push chains 421, two extend laterally along the storage container 41 to the two front upper corner portions of the storage container 41. The third push chain 421 terminates approximately centrally at the upper rear transverse edge of the storage container 41. Accordingly, chain sleeves 411 are mounted at the two front upper corner portions and approximately centrally at the rear transverse edge of the storage container 41.

Such an arrangement of 3 push chains 421 provides balanced stable support for the storage container 41 when it is lifted to prevent tipping.

The arrangement "in the corner portion", as opposed to the centered arrangement, means that one or more push chains 421 are intentionally mounted off-center. The further the push chains 421 are mounted towards the corner of the storage container, the greater the lever arms for stabilizing the storage container 41.

If, starting from a retracted position of the sliding element 3, as shown in FIG. 1*a* or 2*a*, the drive assembly 5 is actuated in order to extend the push chains 421, this first leads to an extension of the sliding element 3, as shown in FIG. 1*b* or 2*b*, respectively. The prerequisite for this is that a smaller force is required for the pushing movement of the sliding element 3 than for the deflection of the push chains 421 and the lifting of the storage container 41. In particular in the case of pull-out guides 32, which are not designed as sliding guides but are equipped with rolling elements, this prerequisite is also given when the storage container 41 is unfilled.

The extension of the sliding element 3 continues with further actuation of the drive assembly 5 until the sliding element 3 has reached its maximum extension position and is stopped at this position by a stop, for example formed within the pull-out guide 32. The maximum extension position of the sliding element 3 is shown in FIGS. 1*c* and 2*c*, respectively.

Further extension of the push chains 421 leads to a deflection of their horizontal movement in the deflection guides 422 and a vertical movement of the front area of the push chains 421, which accordingly lift the storage container 41 via the chain sleeves 411, as shown in FIGS. 1*d* and 2*d* respectively. The maximum height that is reached with the storage container 41 is thereby predetermined by the lengths of the push chains 421 used. It can be provided that the movement is stopped by sensing the maximum extended position and controlling the drive assembly 5 accordingly. A limitation by a mechanical stop, for example realized at the free end of the push chains 421 is also conceivable. Any type of limit switches can also be used.

By using a self-locking drive assembly 5 and/or by continuously energizing the drive assembly 5, optionally with a reduced current value, it is possible to hold the storage container 41 in the raised position until the storage container 41 is lowered and retracted again.

In the exemplary embodiment shown, vertical guidance, i.e., guidance of the storage container 41 in the lifting movement, is achieved only by the push chains 421. The restricted freedom of movement of the chain links of the push chains 421 prevents the push chains 421 from buckling and thus the storage container 41 from tilting forward, i.e., away from the carcass 2. Due to the fact that push chains 421 are arranged in the front and at the rear area of the storage container 41, which are also extended synchronously in parallel, tilting of the storage container 41 towards the rear, i.e., towards the carcass 2, is also prevented. The stability of this arrangement is strengthened by the fact that at least one, preferably several, of the chain links of the push chains 421 are fixed in the chain sleeve 411 in a rotationally fixed manner relative to the storage container 41.

The deflection guides 422 for the laterally arranged push chains 421 are attached directly to the frame elements 33. The deflection guide 422 for the middle of the push chains 421 is positioned on cross members 423 centrally behind the storage container 41. In the exemplary embodiment shown, the cross members 423 are formed by tubes to save material.

FIGS. 3*a*, 3*b* and 4-6 show details of the push-chain assembly 42 and the drive assembly 5 in various views.

Figure 3B:
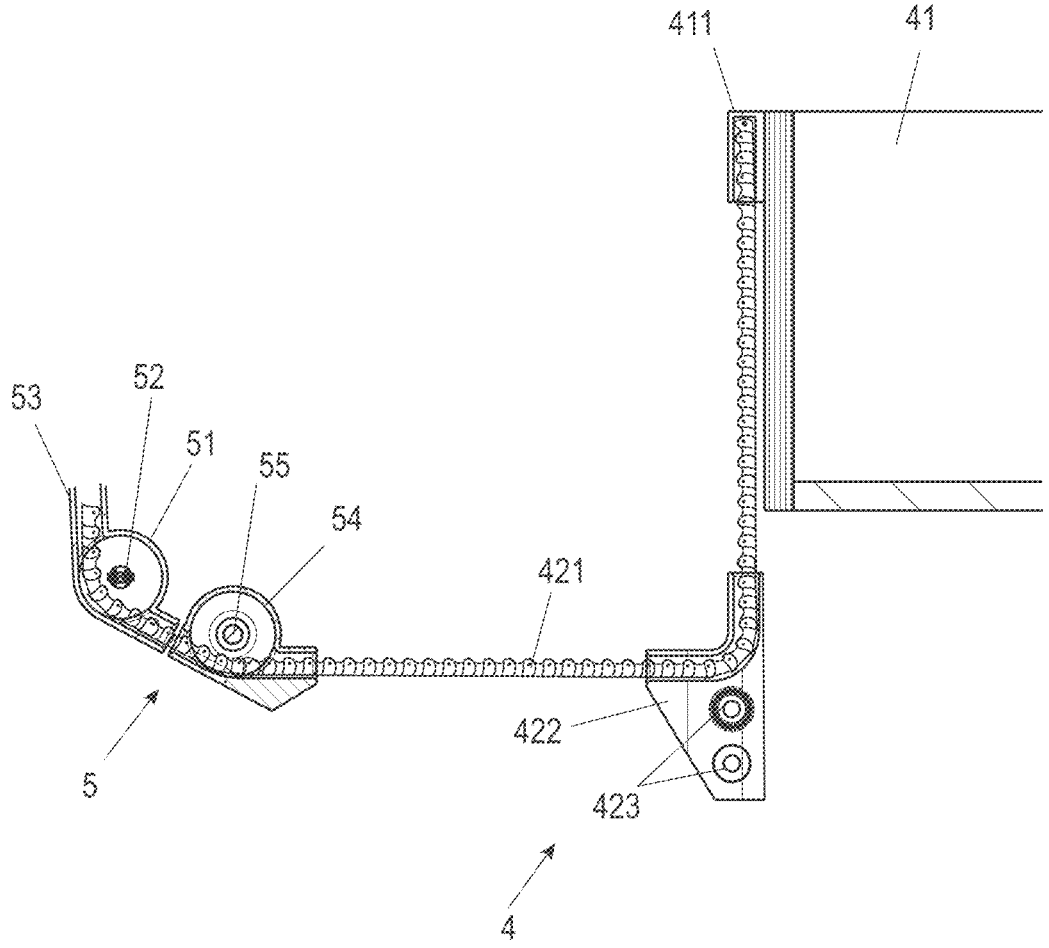

FIGS. 3*a* and 3*b* first show a vertical section through the push-chain assembly 42 and drive assembly 5 in a plane in which the center push chain 421 extends. Here, FIG. 3*a* shows the maximum extended but still lowered position of the storage container 41 and FIG. 3*b* shows the maximum extended and raised state of the storage container 41. Thus, the state shown in FIG. 3*a* corresponds to the state shown in FIGS. 1*c* and 2*c*, respectively, and the state shown in FIG. 3*b* corresponds to the state shown in FIGS. 1*d* and 2*d*, respectively.

FIG. 4 shows an isometric enlarged view of the drive assembly 5. FIG. 5 shows, also in an isometric view, the area of the center push chain 421 in the extended state, and FIG. 6 shows an isometric detailed view of the area of the center deflection guide 422 with the storage container 41 slightly raised.

The drive assembly 5 has a drive motor 51 acting on the push chain 421 via an output gear 52. Advantageously, only one drive assembly 5 with only one drive motor 51 is provided for the entire arrangement. In the illustrated exemplary embodiment, the drive motor 51 acts on the middle of the push chains 421 via the drive gear 52. The drive motor 51 is preferably provided with an integrated gearbox in order to move the push chain 421 at a correspondingly reduced speed and high thrust force. Advantageously, the gearbox is self-locking, for example by comprising a single or multiple worm gear. Power is transmitted from the output gear 52 to the push chain 421 by guiding the push chain 421 around the output gear 52 in a certain angular range, presently about 60 degrees.

The end of the push chain 421 facing away from the storage container 41 is guided in a receiving tube 53, which is approximately vertical and may be guided along the rear side of the furniture carcass 2. The receiving tube 53 may be formed as a tubular socket, as in the example shown, so that the push chain 421 moves freely upwardly behind the furniture carcass when the sliding element 3 is retracted. Alternatively, the receiving tube 53 may also be of corresponding length and closed so that it can completely accommodate the push chain 421. In order to avoid contamination of the push chain 421, a closed receiving tube 53 is advantageous. Alternatively, another form of chain storage device can be used following a shortened receiving tube 53, in which the chain is rolled up, for example, if the installation space in the furniture carcass is limited in this area and a larger vertical extension is not possible. For illustration reasons, the free end of the push chain 421 is shown shortened in FIG. 3*a*.

To enable the movement of the arrangement with only one drive motor 51 and also to achieve synchronization of the movement of all three push chains 421, the movement of the center push chain 421 is transmitted to the lateral push chains 421 via a synchronizing shaft 56. For this purpose, a synchronizing gear 54 is provided which picks up the movement of the center push chain 421 with a gear 55 and transmits it to the synchronizing shaft 56 on both sides to comparable synchronizing gears which in turn drive the respective lateral push chain 421. In an alternative design, synchronization can also be performed directly from the output gear 52 of the drive motor 51 via a synchronizing shaft.

It is understood that such mechanical synchronization may also be implemented when more than one drive motor is provided. Also, the position of the drive motor that drives the middle of the push chains 421 in the example shown is purely exemplary. It would be equally conceivable that only one or both of the lateral push chains 421 are driven and their movement is transmitted accordingly via the synchronizing shaft 56.

FIGS. 7 and 8 each show, in isometric detail, views of a second exemplary embodiment of a domestic appliance with a sliding element 3 and a sliding and lifting arrangement 4. With regard to the basic structure, the exemplary embodiment shown here corresponds to the exemplary embodiment described above, the description of which is hereby explicitly referred to. In particular, differences between the two exemplary embodiments are discussed below.

In this exemplary embodiment, too, a storage container 41 is arranged in a sliding element 3, of which a frame element 33, guided via a pull-out guide 32, and a front panel 31 connecting the frame elements 33 are visible in FIGS. 7 and 8. In this (as in the previously described) exemplary embodiment, the pull-out guide 32 is designed as a full-extension pull-out guide comprising a carcass rail 321 mounted on the carcass 2, a center rail 322 mounted so as to be displaceable relative thereto and a running rail 323 mounted so as to be displaceable relative thereto.

In the exemplary embodiment of FIGS. 7 and 8, a locking lever 324 is pivotally mounted on the track. The locking lever 324 is formed as a two-sided lever, with a first, front lever arm of the locking lever 324 projecting freely forward toward the front panel 31. The opposite second lever arm is provided with a pawl 325 which, in the fully extended position of the drawer slide 32 as shown, projects along the center rail 322 to in front of the front end of the carcass rail 321. The locking lever 324 is slightly angled. In the position shown, which the locking lever 324 assumes due to gravity when its front portion is free to move, reinsertion of the pull-out guide 32 is blocked because the pawl 325 rests against the front end of the carcass rail 321.

The locking lever 324 assumes the position shown as long as the storage container 41 is raised. When the storage container 41 is lowered, an actuator 412 projecting laterally from the storage container 41 and shaped like a bolt here presses down the free end of the locking lever 324, whereupon the pawl 325 is raised and the movement of the running rail or the center rail relative to the carcass rail 321 is released again.

The locking lever 324, together with the actuator 412, forms a retraction lock that ensures the sliding element 3 cannot be retracted when the storage container 41 is raised, which could otherwise lead to collisions of the storage container 41 with the carcass 2 of the domestic appliance 1. As an alternative possible retraction lock, the use of electromechanical switches or sensors can be considered, which detect whether the storage container 41 is in the lowered or a raised position. Suitable actuators can then be used to block the retraction of the storage container 41 depending on the detected position.

A further difference of the exemplary embodiment of FIGS. 7 and 8 from the exemplary embodiment described above is that in addition to the push-chain assembly 42, a sliding guide 43 is provided between the sliding element 3 and the storage container 41, which supports vertical guidance of the storage container 41. In the present case, the sliding guide 43 is mounted on the frame element 33 on the side of the sliding element 3. Mounting on the front panel 31 is also conceivable.

Due to this sliding guide 43, the storage container 41 can only be moved linearly in relation to the front plate 31; tilting is thus prevented. This makes it possible to minimize the number of push chains 421 so that they ultimately only have to be designed for extending and lifting, but an additional function of stabilizing the storage container 41 against tipping by means of the push chains 421 is not required.

In this exemplary embodiment, it is thus sufficient if, for example, only the center push chain 421 is used.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Domestic appliance
2 Carcass
21 Side wall
22 Base
3 Sliding element
31 Front panel
32 Pull-out guide
321 Carcass rail
322 Center rail
323 Running rail
324 Locking lever
325 Pawl
33 Frame element
4 Sliding and lifting arrangement
41 Storage container
411 Chain sleeve
412 Actuator
42 Push-chain assembly
421 Push chain
422 Deflection guide
423 Cross member
43 Sliding guide
5 Drive assembly
51 Drive motor
52 Output gear
53 Receiving tube
54 Synchronizing gear
55 Gear
56 Synchronizing shaft

The invention claimed is:

1. A domestic appliance, comprising:
a carcass;
a drive assembly arranged in or on the carcass;
a sliding element extendible from the carcass the drive assembly;
a deflection guide arranged on the sliding element;
a liftable storage container configured to move out of the carcass by the sliding element; and
a push-chain assembly comprising a push chain drivable by the drive assembly, wherein a free end of the push chain is fixed to the liftable storage container and the push chain extends between the drive assembly and the storage container through the deflection guide,
wherein the push chain is configured to convert a horizontal movement of the push chain into a vertical movement,
wherein, starting at the free end of the push chain, the push chain enters the deflection guide in a horizontal direction, passes through the deflection guide, exits the deflection guide in a vertical direction, and continues to the drive assembly, and
wherein the drive assembly drives the push chain and the liftable storage container in the horizontal direction until the sliding element and the liftable storage container are fully extended and then the drive assembly continues to drive the push chain through the deflection guide to create vertical movement of the push chain and liftable storage container.

2. The domestic appliance of claim 1, wherein the push chain is fixed to a rear side, as viewed in a pull-out direction, of the storage container.

3. The domestic appliance of claim 1, wherein the drive assembly comprises a drive motor having an output gear engaging the push chain.

4. The domestic appliance of claim 3, wherein the drive motor is configured to act on the output gear via a self-locking gear.

5. The domestic appliance of claim 1, wherein the deflection guide comprises a quarter-circular slideway for the push chain.

6. The domestic appliance of claim 1, further comprising:
at least one chain sleeve indirectly or directly attached to or formed on the liftable storage container, wherein the free end of the push chain is non-rotatably fixed in the at least one chain sleeve.

7. The domestic appliance of claim 1, wherein the sliding element is mounted on the carcass so as to be linearly displaceable via a pull-out guide.

8. The domestic appliance of claim 1, wherein the liftable storage container is mounted vertically displaceably on the sliding element via a sliding guide.

9. The domestic appliance of claim 1, further comprising:
a retraction lock configured to lock the sliding element in an extended position if the liftable storage container is lifted.

10. The domestic appliance of claim 1, wherein the domestic appliance is a refrigerator, freezer, or a refrigerator and freezer.

11. A domestic appliance, comprising:
a carcass;
a drive assembly arranged in or on the carcass;
a sliding element extendible from the carcass the drive assembly;
a deflection guide arranged on the sliding element;
a liftable storage container configured to move out of the carcass by the sliding element; and
a push-chain assembly comprising a push chain drivable by the drive assembly, wherein a free end of the push chain is fixed to the liftable storage container and the push chain extends between the drive assembly and the storage container through the deflection guide,
wherein the push chain is configured to convert a horizontal movement of the push chain into a vertical movement,
wherein, starting at the free end of the push chain, the push chain enters the deflection guide in a horizontal direction, passes through the deflection guide, exits the deflection guide in a vertical direction, and continues to the drive assembly, and
wherein the push chain assembly further comprises a second push chain and a third push chain, wherein the push chain, the second push chain, and the third push chain extends parallel to and spaced apart from each other.

12. The domestic appliance of claim 11, wherein the second and third push chains are fixed in front corner portions of the liftable storage container.

13. The domestic appliance of claim 12, wherein the push chain fixed to a rear side, as viewed in a pull-out direction, of the storage container.

14. The domestic appliance of claim 13, wherein the push chain, the second push chain, and the third push are configured to synchronously move by the drive assembly.

15. The domestic appliance of claim 14, further comprising:

a synchronous shaft extending transversely to an orientation of the push chain, the second push chain, and the third push and configured to synchronize movement of the push chain, the second push chain, and the third push.

16. The domestic appliance of claim 11, wherein the domestic appliance is a refrigerator, freezer, or a refrigerator and freezer.

17. The domestic appliance of claim 11, wherein the push chain is fixed to a rear side, as viewed in a pull-out direction, of the storage container.

18. The domestic appliance of claim 11, wherein the drive assembly comprises a drive motor having an output gear engaging the push chain.

19. The domestic appliance of claim 18, wherein the drive motor is configured to act on the output gear via a self-locking gear.

20. The domestic appliance of claim 11, wherein the deflection guide comprises a quarter-circular slideway for the push chain.

* * * * *